US008757486B2

(12) United States Patent
Cook et al.

(10) Patent No.: US 8,757,486 B2
(45) Date of Patent: Jun. 24, 2014

(54) METHODS AND APPARATUS FOR INTERCEPTING A PROJECTILE

(75) Inventors: James M. Cook, Tucson, AZ (US); Robert S. Brinkerhoff, Tucson, AZ (US); Michael J. Mahnken, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 732 days.

(21) Appl. No.: 12/134,994

(22) Filed: Jun. 6, 2008

(65) Prior Publication Data

US 2012/0211562 A1 Aug. 23, 2012

Related U.S. Application Data

(60) Provisional application No. 60/942,845, filed on Jun. 8, 2007.

(51) Int. Cl.
*G06G 7/80* (2006.01)

(52) U.S. Cl.
USPC ..... 235/400

(58) Field of Classification Search
USPC ..... 235/400; 89/1.11
See application file for complete search history.

(56) References Cited

U.S. PATENT DOCUMENTS

| | | | | |
|---|---|---|---|---|
| 5,435,503 | A | 7/1995 | Johnson, Jr. et al. | |
| 6,497,169 | B1 * | 12/2002 | Khosla | 89/1.11 |
| 6,771,205 | B1 | 8/2004 | Barton et al. | |
| 6,920,827 | B2 | 7/2005 | Lloyd | |
| 7,066,427 | B2 | 6/2006 | Chang | |
| 7,077,045 | B2 | 7/2006 | Dietrich et al. | |
| 7,190,304 | B1 | 3/2007 | Carlson | |
| 7,202,809 | B1 | 4/2007 | Schade et al. | |
| 7,205,932 | B2 | 4/2007 | Fiore | |
| 2002/0149510 | A1 | 10/2002 | Salzeder | |
| 2003/0019350 | A1 | 1/2003 | Khosla | |
| 2006/0175464 | A1 | 8/2006 | Chang | |
| 2010/0274415 | A1 * | 10/2010 | Lam | 701/3 |

FOREIGN PATENT DOCUMENTS

WO 2006079029 A2 7/2006

OTHER PUBLICATIONS

Raytheon U.S. Appl. No. 11/470,900, filed Sep. 7, 2006 for System and Method for Attitude Control of a Flight Vehicle using Pitch-Over Thrusters, not yet published.
Supplementary European Search Report from corresponding European Application No. 08835611.8, mailed on Nov. 19, 2012.

* cited by examiner

*Primary Examiner* — Daniel Hess
(74) *Attorney, Agent, or Firm* — Renner, Otto, Boisselle & Sklar, LLP

(57) ABSTRACT

Methods and apparatus for firing a projectile in response to a threat according to various aspects of the present invention operate in conjunction with a computer coupled to a launch system for the projectile. The computer may be configured to select the projectile from multiple available projectiles and calculate a fire control solution according to a characteristic of the selected projectile. Calculating the fire control solution may comprise deriving the fire control solution from a look-up table according to a predicted intercept point. The computer may initiate a launch of the selected projectile and provide the fire control solution to the selected projectile.

22 Claims, 4 Drawing Sheets

METHODS AND APPARATUS FOR INTERCEPTING A PROJECTILE

CROSS-REFERENCES TO RELATED APPLICATIONS

This application claims the benefit of U.S. Provisional Patent Application No. 60/942,845, filed Jun. 8, 2007, and incorporates the disclosure of the application by reference.

BACKGROUND OF INVENTION

Modern warfare has developed new threats and new uses for old weapons. Deployments place units in areas exposed to a variety of weapons fired at close range and with little warning. Countermeasures must be developed and deployed to neutralize such threats.

For example, various rocket-propelled grenades (RPGs) are widely used against armored and unarmored targets. RPGs are typically fired within a few hundred meters of a target, and often from doorways and behind walls, providing little reaction time. Urban environments are particularly suited to PRG attacks.

Countermeasures may be available against many types of projectiles. Under many conditions, however, the countermeasures must be deployed extremely quickly, limiting the effectiveness of many countermeasures. In addition, some countermeasures, such as extra armor, may not be suited to particular units.

SUMMARY OF THE INVENTION

Methods and apparatus for firing a projectile in response to a threat according to various aspects of the present invention operate in conjunction with a computer coupled to a launch system for the projectile. The computer may be configured to select the projectile from multiple available projectiles and calculate a fire control solution according to a characteristic of the selected projectile. Calculating the fire control solution may comprise deriving the fire control solution from a look-up table according to a predicted intercept point. The computer may initiate a launch of the selected projectile and provide the fire control solution to the selected projectile.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

Figure 1:
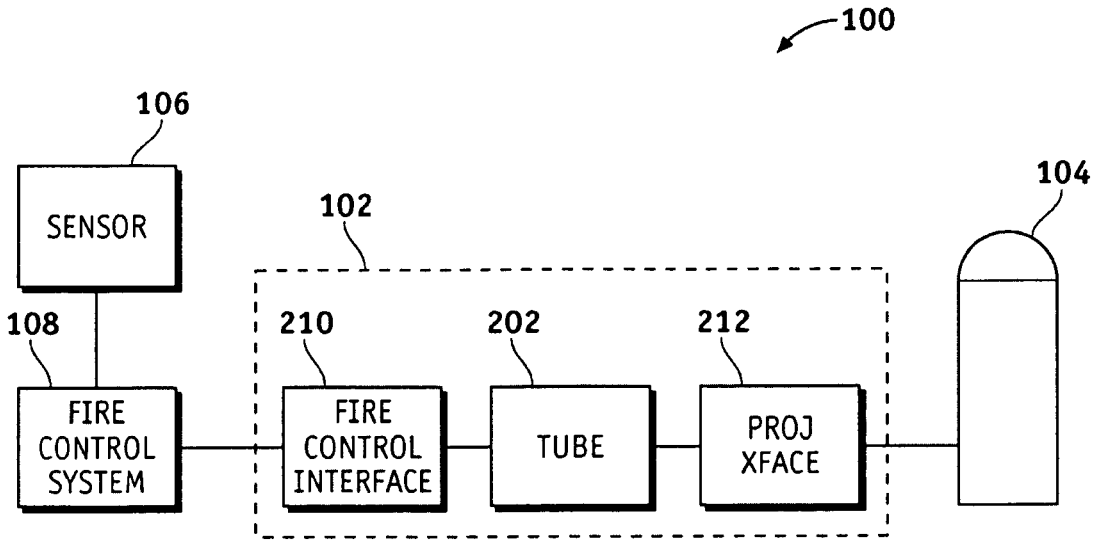
FIG. 1 is a block diagram of a diagram of a countermeasure system according to various aspects of the present invention.

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of hardware or software components configured to perform the specified functions and achieve the various results. For example, the present invention may employ various projectiles, sensors, launch systems, computers, tracking systems, target identification and tracking algorithms, fire control solution algorithms, and the like, which may carry out a variety of functions. In addition, the present invention may be practiced in conjunction with any number of projectiles such as countermeasures, interceptors, missiles, or rockets, and the system described is merely one exemplary application for the invention. Further, the present invention may employ any number of conventional techniques for launching projectiles, targeting objects, propulsion, and the like.

Further, embodiments may be described as a process or function which is depicted as a flowchart, flow diagram, data flow diagram, structure diagram, or block diagram. Although such illustrations may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a medium, such as portable or fixed storage devices, optical storage devices, wireless channels and various other media capable of storing, containing or carrying instructions and/or data, and a processor may perform the necessary tasks. A code segment may represent a procedure, function, subprogram, program, routine, subroutine, module, software package, class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable technique or mechanism including memory sharing, message passing, token passing, network transmission, etc.

Methods and apparatus according to various aspects of the present invention may be embodied as a method, a system, a device, and/or a computer program product. Accordingly, such apparatus and methods may take the form of an entirely software embodiment, an entirely hardware embodiment, or an embodiment combining aspects of both software and hardware. The present invention may also comprise a computer program product on a computer-readable storage medium having computer-readable program code embodied in the storage medium. Any suitable computer-readable storage medium may be utilized, including hard disks, CD-ROM, optical storage devices, magnetic storage devices, USB memory keys, and/or the like.

Figure 2:
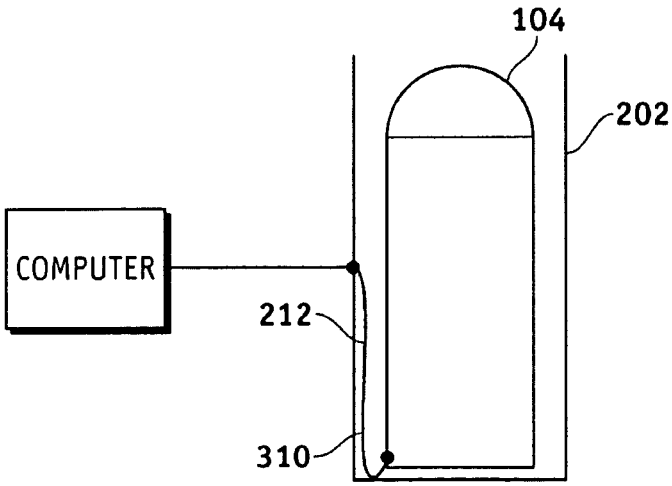
FIG. 2 is a cross-sectional illustration of a projectile in a tube launcher.

Methods and apparatus for fire control according to various aspects of the present invention may operate in conjunction with a countermeasure system that launches of an effector, such as one or more projectiles, in response to a threat. Referring now to FIGS. 1 and 2, one embodiment for methods and apparatus for countermeasures may operate in conjunction with a projectile 104, a launcher 102, a sensor 106, and a fire control system 108. The fire control system 108 is connected to the projectile via the launcher 102, and controls the launch of the projectile 104 from the launcher 102. The fire control system 108 may control the launch of the projectile 104 according to data from the sensor 106. The present countermeasure system 100 is configured for intercepting short-range threats, such as threats posed by rocket-propelled grenades (RPGs) to military units. Such threats involve very brief intervals for target detection, identification, tracking and intercept. Various aspects of the present invention, however, may be adapted for other countermeasure systems or other systems for launching effectors.

The projectile 104 may comprise a moving system, for example to deliver a payload. The projectile 104 may comprise any system operating in conjunction with the launcher 102, such as a missile, a rocket, or an aircraft. In one exemplary embodiment, the projectile 104 comprises a guided countermeasure intended to intercept an incoming threat. For example, the projectile 104 may comprise a countermeasure against a rocket propelled grenade (RPG). In the present embodiment, the projectile 104 comprises a short-range countermeasure missile comprising a forward-firing warhead. The countermeasure projectile 104 may be adapted for vertical launch while receiving a fire control solution. The projectile 104 may include control elements, such as fins and/or pitch-over thrusters, to guide the projectile 104 to the target intercept site after launch in accordance with the fire control solution, as well as a fuze for detonating the projectile 104 based on the fire control solution or other criteria, such as target proximity or a timer. The projectile 104 may, however, comprise any appropriate projectile, such as a cargo delivery system, an air-to-air, surface-to-air, air-to-surface, or surface-to-surface missile, an underwater- or space-based projectile, or other system. Further, the projectile 104 may comprise or be replaced by a non-projectile effector, such as a sensor or other deployable element.

The launcher 102 launches the projectile 104 in response to signals from the fire control system 108. The launcher 102 may comprise any suitable launch system, such as a conventional launch tube or canister. Referring to FIG. 2, in an exemplary embodiment, the launcher 102 comprises a tube launcher 202 configured to house at least one projectile 104. The launcher 102 may further be configured to house the projectile 104 in a substantially vertical position prior to launch. For example, the launcher 102 may be installed on a vehicle and positioned at a ninety degree angle relative to the ground to launch the projectile 104 vertically upwards with respect to the vehicle.

The launcher 102 may comprise any additional systems for launching the projectile, such as a fire control system interface 210 and a projectile interface 212. The fire control system interface 210 effects communication between the fire control system 108 and the launcher 102. The projectile interface 212 effects communication between the launcher 102 and the projectile 104.

The fire control system interface 210 may comprise any suitable system for receiving communications from the fire control system 108 and/or providing communications to the fire control system 108. In one embodiment, the fire control system interface 210 comprises a launch control box, such as a conventional launch control box including arming systems and communication elements for exchanging signals with the fire control system 108.

In the present embodiment, the fire control system interface 210 receives a fire control solution and a launch signal from the fire control system 108. The fire control solution comprises data for guiding the projectile 104 to a target intercept site, for example to destroy or disable an incoming threat. The launch signal indicates whether and when to launch the projectile 104. The fire control system interface 210 may facilitate the exchange of other suitable signals between the launcher 102 and the fire control system 108, such as status check, diagnostics, command echo, fire control solution readback, or other appropriate signals.

The projectile interface 212 may comprise any appropriate system for facilitating communications between the projectile 104 and the launcher 102. In the present embodiment, the projectile interface 212 transfers fire control solution signals to the projectile 104 to guide the projectile 104 and the launch signal to initiate launch of the projectile 104. The projectile interface 212 may also facilitate transfer of other signals, such as status check, diagnostics, command echo, fire control solution readback, or other appropriate signals.

The projectile interface 212 may comprise a physical or wireless medium for transferring signals. For example, the projectile interface 212 may comprise wireless RF transmitters and/or receivers associated with the launcher 102 and the projectile 104 for exchanging signals. Alternatively, the projectile interface 212 may comprise a physical interface such as a ribbon cable, one or more serial interface cables, coaxial cables, rigid connectors, or slots.

The projectile interface 212 may continue to transfer signals to the projectile 104 after initiation of the launch from the launcher 102, such as until the projectile 104 completes egress from the tube. For example, the projectile interface 212 may remain connected to the projectile 104 while the projectile 104 is moving through the tube and disconnect from the projectile 104 at some point after the projectile 104 begins moving, such as during or after egress from the tube. Maintaining connection of the projectile interface 212 facilitates updating the fire control solution to the projectile 104 during the launch until the projectile interface 212 disconnects.

In one embodiment, the projectile interface 212 comprises a tether 310 comprising a substantially flexible material connected to the launcher 102 and the projectile 104. The tether 310 may comprise any appropriate flexible medium for transferring signals, such as flexible metal conductors or fiber optics. One end of the tether 310 is secured to the tube and the other end is detachably connected to the projectile 104. The tether 310 is adapted to remain connected to the projectile 104 prior to launch and after initiation of launch while the projectile 104 is exiting the tube. At some point during or after egress, the tether 310 detaches from the projectile 104, such as in response to the tether 310 becoming taut and pulling away from the projectile with 104 a selected detachment force.

The projectile interface 212 may comprise alternative systems for transferring signals to the projectile 104 while the projectile is moving, such as rigid connectors than maintain contact while the projectile is moving. For example, the projectile interface 212 may comprise an electrical connector extending from the bottom of the projectile 104 and contacting a conductive strip along the vertical interior of the tube. Alternatively, the projectile interface 212 may comprise an electrical connector extending from the top of the tube and contacting a conductive strip running along the side of the projectile 104. In either case, as the projectile 104 moves relative to the tube, the electrical connector remains in contact with the conductive strip until the projectile 104 exits the tube, facilitating communications between the projectile 104 and the launcher 102.

The sensor 106 generates signals corresponding to the target of the projectile 104 and/or other environmental data, such as wind speed, temperature, or friendly unit locations. The sensor 106 may comprise any suitable sensor for generating any appropriate target data. In the present embodiment, the sensor 106 comprises a tracking system for identifying and tracking targets, such as a radar system, infrared sensor, navigation systems, depth indicators, sonar, electronic warfare equipment, data systems, or other suitable source of relevant data. In the present embodiment, the sensor 106 comprises an active electronically steered array having sufficient range and resolution to identify relevant threats, such as incoming RPGs. Other embodiments may comprise other sensor and/or data systems, such as phased array radars, planar radar arrays, a conventional antenna, a forward-looking infrared sensor, semi-active laser sensors, or a combination of data received from one or more other sensors. The sensor 106 also suitably includes a temperature sensor for generating a signal corresponding to the ambient temperature.

In the present embodiment, the sensor 106 generates target data at a frequency such that the firing solution may be calculated or updated between initiation of launch and loss of the connection to the projectile 104. For example, the sensor 106 may generate updated target information at 30 to 40 millisecond intervals, while the projectile 104 may require 50 to 100 milliseconds to exit the launcher 102 from assertion of the launch signal. The updated target information may be provided by the sensor 106 to the fire control system 108 to provide an updated fire control solution to the projectile 104 while the projectile 104 has already started moving in response to the launch signal.

The fire control system 108 receives data from the sensor 106 and generates guidance data for the projectile 104. The fire control system 108 may comprise any appropriate system for generating guidance data for the projectile 104 according to any relevant data, such as data from the sensor 106 and data retrieved from a memory. For example, the fire control system 108 may comprise a conventional computer comprising a processor and a memory. In the present embodiment, the fire control system 108 operates on a VME chassis.

Figure 5:
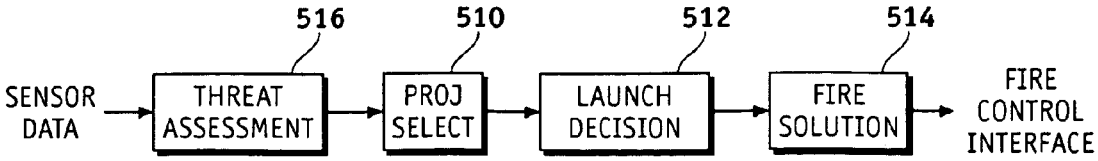
FIG. 5 is a block diagram of a fire control system.

The fire control system 108 may perform any appropriate tasks associated with firing the projectile 104, such as processing the sensor 106 data to detect, discriminate, and track targets, establish a time to launch and generate a launch signal to launch the projectile 104, and calculate the fire control solution. For example, the fire control system 108 may calculate a time to launch the projectile, one or more times for firing guidance and propulsion systems, and a time for detonating the warhead of the projectile 104. In the present embodiment, referring to FIG. 5, the fire control system 108 may include a projectile selection function 510 to select the projectile 104 from an inventory of available projectiles and/or select a launcher 102 from multiple available launchers. The fire control system 108 may also include a launch decision function 512 to determine a launch time and/or initiate the launch of the projectile 104. Further, the fire control system may include a fire solution function 514 to establish a fire solution for guiding the projectile 104 to intercept the target. While the functions and processes are described separately, various aspects of the functions may be combined, executed in a different order, performed concurrently or sequentially, or otherwise modified according to the application or environment.

In the present embodiment, the fire control system 108 receives the data from the sensor 106 and selects one or more targets for intercept by the projectile 104. For example, the fire control system 108 may includes a threat assessment function 516 to process the sensor 106 data according to target tracking algorithms to detect incoming projectiles, identify them as threats, and establish tracks for the threats, such as using conventional algorithms based on range and velocity data. In the present embodiment, the threat assessment function 516 may be implemented in conjunction with conventional target identification and tracking technology or other suitable threat assessment systems and techniques.

The fire control system 108 may also determine whether to launch the projectile 104 in response to the detected threat. For example, the fire control system 108 may select a particular projectile 104 from multiple projectiles 104 available for deployment. In the present embodiment, the projectile selection function 510 comprises selects the projectile 104 for attacking the target from a current inventory of possible projectiles, such as long-, medium-, and short-range countermeasures. The projectile selection function 510 may further select a launcher 202 from among multiple available launchers.

The projectile selection function 510 may select the projectile 104 and/or the launcher 202 according to any appropriate criteria, such as the type of target, range to the target, the target's approach speed and angle, and the presence of friendlies in the area. In the present embodiment, the projectile selection function 510 receives one or more input data, such as information relating to the currently available projectile 104 inventory, positions of available launchers 202, no-fire zones in the area, ambient temperature, and threat-state information, such as raw sensor 106 data and information derived from the sensor 106 data.

The projectile selection function 510 selects a projectile for intercepting or otherwise countering the threat or engaging the target according to any suitable criteria. In the present embodiment, the projectile selection function 510 selects a projectile 104 and/or launcher 202 according to a predicted intercept point according to the projectile 104 time-of-flight (TOF) and the threat TOF to that intercept point. The projectile selection function 510 may further optimize the projectile 104 and/or launcher 202 selection according to other relevant criteria, including distance to the intercept point, engagement angle (the angle between the projectile's longitudinal axis and the threat's longitudinal axis at projectile 104 detonation), projectile 104 inventory, no-fire and obstruction zones, launcher positions, and threat state.

Figure 6:
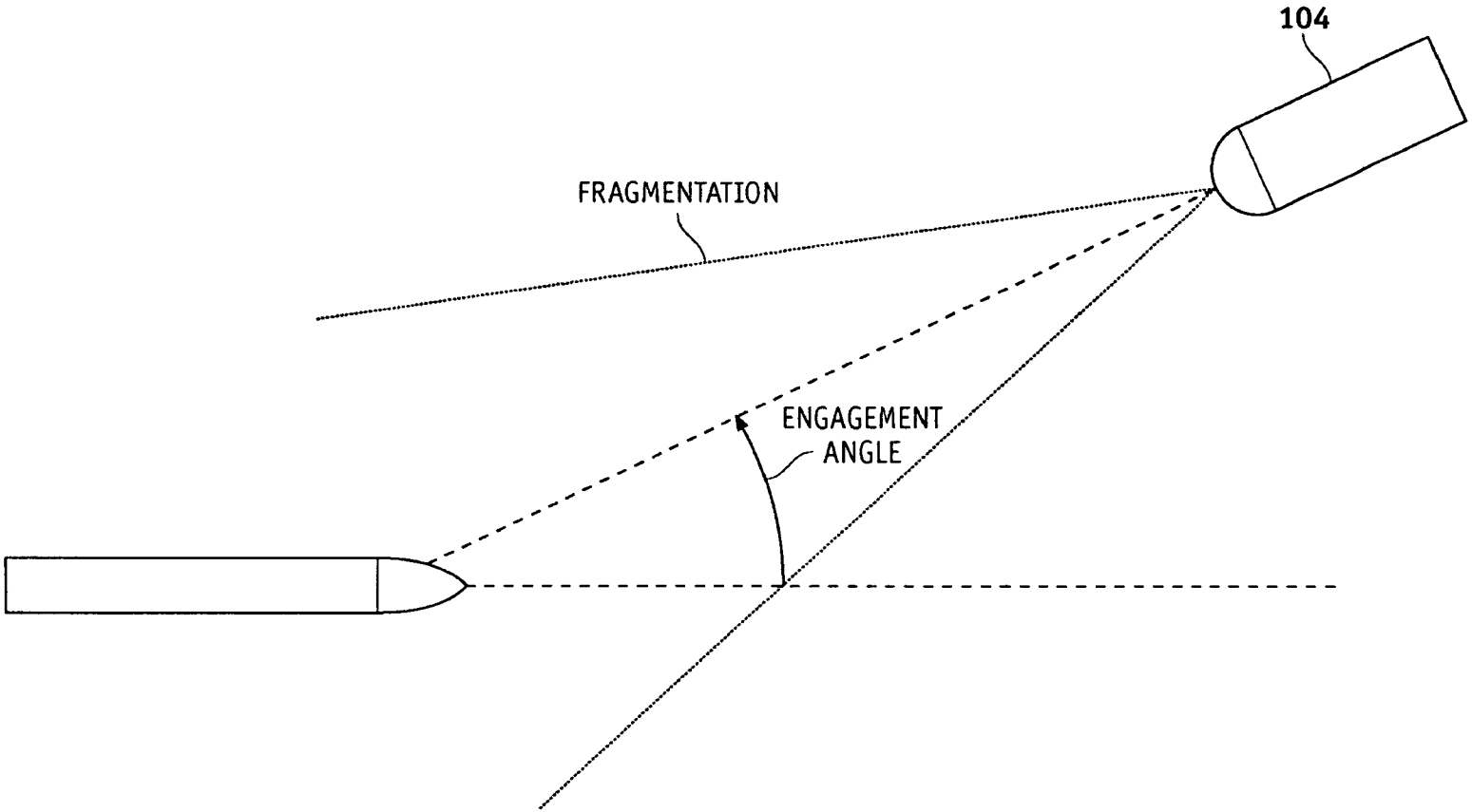
FIG. 6 illustrates an engagement angle between a projectile and a threat.

Any appropriate algorithm may be applied to select the appropriate projectile 104 and/or launcher 202. For example, many short-range countermeasures are less accurate at greater distances to the intercept point, which may weigh in favor of selecting a longer range countermeasure or utilizing a launcher 202 that is closer to the intercept point. In addition, referring to FIG. 6, projectile selection function 510 may analyze the engagement angle for a particular projectile 104 and launcher selection. If the engagement angle is small, fragments from the projectile 104 warhead may impact the threat's fuze and detonate the warhead, presenting a potential threat. As the engagement angle increases, the cross-sectional area of the threat that the fragments can impact also increases, which increases the probability of defeating the threat. In some cases, the projectile 104 and/or launcher 202 offering the optimal engagement angle may not be the nearest to the target, but the increase in the projectile's TOF may cause the projectile selection function 510 to select the nearest projectile 104 and/or launcher 202 despite the less optimal engagement angle, and vice versa.

In many situations, the projectile selection, launch decision, and fire solution may be calculated extremely quickly to counter a threat. The present projectile selection function 510 operates in conjunction with a look-up table to facilitate interception of the threat at any point within an area of protection. The look-up table may comprise any suitable information that affects interception of the threat, such as threat vector data, intercept point data such as elevation and azimuth, motor and warhead fire times, projectile 104 launch times, predicted time-of-impact, and any other appropriate data.

An the present embodiment, the look-up table calculates projectile 104 selection, launcher 202 selection, and fire-times for any intercept point within the area of protection according to range, azimuth, elevation, and ambient temperature. The look-up table may be generated in any appropriate manner, such as applying various launch times, motor fire-times, and detonation times for different intercept points, launchers 202, and projectiles 104 to a simulator to calculate the azimuth and elevation of the resulting fragment pattern center. The information may then be inverted through a series of interpolations to produce look-up tables with any appropriate variables, such as azimuth and elevation. The process may be repeated for different intercept ranges and ambient temperatures and compiled. The resulting look-up table may be interpolated to provide the fire-times required to hit any intercept point within the area of protection by any projectile 104 from any launcher 202, specified by range, azimuth, elevation, ambient temperature, and/or other relevant criteria. In addition, by comparing effectiveness of various projectiles 104 and launchers 202 for various intercept points, the various projectiles 104 in the inventory and available launchers 202 may be ranked for any particular intercept point within the look-up table to automatically select the projectile 104 and/or launcher 202 according to the range, azimuth, elevation, ambient temperature, and/or other relevant criteria. Thus, the look-up table may provide fire-time solutions for all engagement scenarios within the area of protection.

The launch decision function 512 determines a launch time for the selected projectile 104. In addition, the fire control system 108 may determine whether to launch the projectile 104, such as based on likelihood of impact, probability that the incoming threat is actually a decoy, potential danger to friendlies, or other criteria. In the present embodiment, the launch decision function 512 utilizes the fire-time look-up table and the threat state to calculate the projectile 104 launch time. The launch decision function 512 may generate a time-to-launch and a Boolean launch/no-launch variable, which facilitates preparation and initiation of the launch, for example by the sensor 106 and the fire control system 108. For example, the launch decision function 512 may identify a time at which the incoming threat will be within range of the projectile 104 or likely to become an immediate threat. The fire control system 108 may then initiate the launch in accordance with the computed time-to-launch, such as by asserting a launch signal to the launcher 102.

If the fire control system 108 elects to launch the projectile 104, the fire control system 108 may compute a fire control solution for guiding and/or detonating the projectile 104. For example, the fire control solution 108 may receive sensor 106 data and generate a target track. The fire control system 108 may generate the fire control solution based on any relevant data, such as the relative motion of the target to the launcher 102, characteristics of the projectile 104, and exterior ballistics. In one embodiment, the fire control system 108 may generate the fire control solution using conventional algorithms and techniques based on target position, course, speed and bearing, relative velocities, bearing change rate, range change rate, speed across line-of-sight, estimated target position, gravity, drag, wind, drift, Coriolis effects, and/or any other relevant factors.

In the present embodiment, the fire solution function 514 establishes a fire solution for guiding the projectile 104 to intercept the target in conjunction with the look-up table. For example, the fire solution function 514 may calculate the motor and warhead fire-times that will cause the selected projectile 104 to intercept the incoming threat. The fire solution function 514 may calculate the predicted point of intercept by propagating the threat state forward until the threat TOF to that point is equal to the projectile's 104 TOF to that point. The projectile's 104 TOF is interpolated from the look-up table. To perform the minimization of the difference in TOF, a modified Newton-Raphson method is employed. This method converges quickly and is computationally inexpensive.

After establishing the intercept point, the fire solution function 514 may interpolate the fire-times for the projectile's 104 motor and warhead from the look-up table. The fire-times are then provided to the projectile 104 to guide the projectile 104 to the target. For example, the fire control system 108 may provide the fire control solution to the projectile 104 immediately preceding launch, at the time of launch, and/or following launch. In addition, the fire control system 108 may update the fire control solution provided to the projectile 104 until the connection to the projectile 104, such as via the projectile interface 212, is lost.

In the present embodiment, the fire control system 108 provides the final fire control solution to the projectile 104 after the projectile 104 has initiated launch and before the connection to the projectile 104 via the projectile interface 212 is broken. For example, the fire control system 108 may provide an initial fire control solution to the projectile 104 and continue updating the fire control solution until the projectile interface 212 link terminates. Alternatively, the fire control system 108 may initiate the launch, which starts the projectile 104 moving within the launcher 102. In the meantime, the fire control system 108 may continue receiving target data from the sensor 106 and/or calculating the fire control solution while the projectile 104 is egressing the launcher 102. The fire control system 108 may provide the final fire control solution or an updated fire control solution to the projectile 104 before the tether 310 detaches from the projectile 104 or communication with the projectile 104 is otherwise lost.

By delivering the fire control solution after the projectile 104 has begun launch, the latest sensor 106 data may be used to compute the fire control solution. In addition, the launch process may begin without waiting for the fire control system 108 to complete calculation and delivery of the fire control solution to the projectile to provide an optimal fire control solution and fast reaction time. In addition, updating the fire control solution during egress of the projectile 104 may compensate for variations in egress timing characteristics among projectiles 104 and launching methods.

Figure 3D:
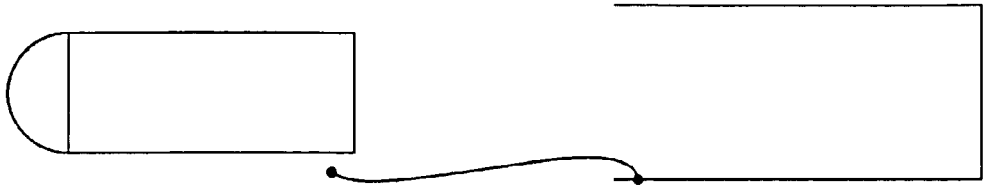
FIGS. 3A-D representatively illustrate the projectile exiting the tube launcher.
Figure 3C:
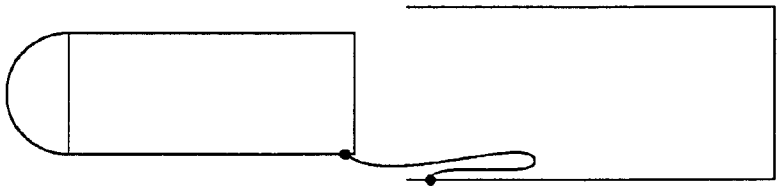
Figure 3B:
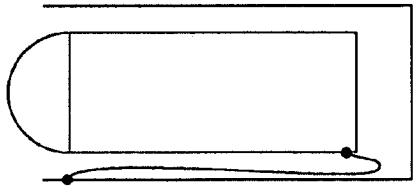
Figure 3A:
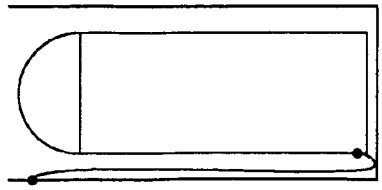
Figure 4:
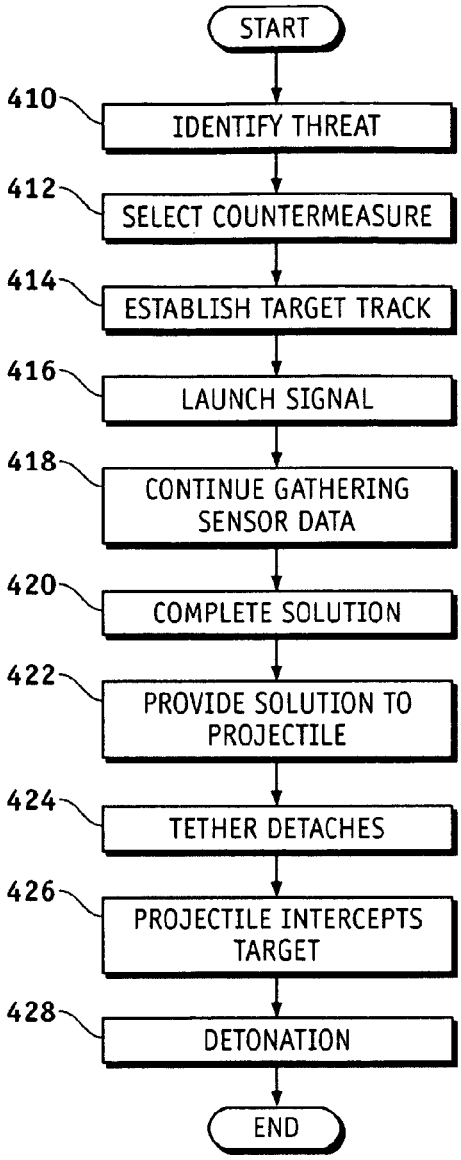
FIG. 4 is a flow chart representatively illustrating a fire control process.

Referring to FIGS. 3 and 4, the countermeasure system 100 may begin operation with multiple projectiles 104 loaded within multiple launchers 102 (FIG. 3A) while the sensor 106 monitors an area. The sensor 106 transfers data to the fire control system 108, which analyzes the data to detect and identify threats.

Upon identification of a threat (410), the fire control system 108 may select an appropriate countermeasure projectile 104

(412) in conjunction with the projectile selection function 510 and establish a track for the identified threat (414). For example, the fire control system 108 may determine an intercept point and apply the intercept point data and any other relevant data into the look-up table. The look-up table generates a projectile 104 selection and a launcher 202 selection. In another embodiment, one or more tracks for may be established prior to identification of a threat.

The fire control system 108 may assert the launch signal (416), causing the projectile 104 to initiate launch from the launcher 102 (FIG. 3B). For example, launch decision function 512 determines a launch time for the selected projectile 104, and the fire solution function 514 establishes the fire solution for guiding the projectile 104 to intercept the target in conjunction with the look-up table. In one embodiment, while the projectile 104 is exiting the launcher 102, the sensor 106 continues to provide target data to the fire control system 108 (418). The fire control system 108 completes the final fire control solution (420) based on the sensor 106 data and provides the final fire control solution to the projectile 104 while the tether 310 remains connected to the projectile 104 (422) (FIG. 3C). The final fire control solution may be delivered as the only fire control solution, or may be provided as an update to a previously delivered fire control solution. As the projectile 104 leaves the launcher 102, the tether 310 detaches from the projectile 104 (424) (FIG. 3D), and the projectile 104 proceeds according to the fire control solution (426). The projectile 104 may approach the target and detonate according to the fire control solution (428), and the target is disabled or destroyed.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. A computer-implementable method for firing a projectile in response to a threat, comprising:

selecting the projectile from multiple available projectiles;

calculating an initial fire control solution according to a characteristic of the selected projectile;

calculating a final fire control solution according to a characteristic of the selected projectile, wherein calculating the final fire control solution comprises deriving the final fire control solution from a look-up table according to a predicted intercept point, wherein the look-up table comprises predetermined countermeasure fire control solutions for multiple engagement scenarios, and wherein the final fire control solution is an updating of the initial fire control solution;

receiving a launch signal to initiate a launch of the projectile;

launching the selected projectile;

before the launching initiates, providing the initial fire control solution to the selected projectile;

after the launching initiates, providing the final fire control solution to the selected projectile; and guiding the selected projectile according to the final fire control solution, wherein the providing includes providing the fire final fire control solution via a projectile interface link that couples the selected projectile to a computer in which the calculating occurs, and wherein the projectile interface link is a physical interface that releases after launch.

2. A computer-implementable method according to claim 1, further comprising calculating the predicted intercept point according to sensor data relating to the threat and the characteristic of the selected projectile.

3. A computer-implementable method according to claim 1, further comprising calculating an initial fire control solution prior to the launching;

wherein the initial fire control solution includes a motor-firing time for the projectile.

4. A computer-implementable method according to claim 1, further comprising:

controlling a fuze to detonate a warhead of the projectile according to the final fire control solution.

5. A computer-implementable method according to claim 1, wherein selecting the projectile comprises selecting the projectile according to a predicted time of flight of the projectile to the predicted intercept point.

6. A computer-implementable method according to claim 1, wherein selecting the projectile comprises selecting the projectile according to a predicted engagement angle of the projectile relative to the threat.

7. A computer-implementable method according to claim 1, wherein the look-up table comprises a collection of predetermined countermeasure fire solutions for multiple predicted intercept points.

8. A machine-readable medium having machine-executable instructions for performing the computer-implementable method for firing a projectile in response to a threat as recited of claim 1.

9. A machine adapted to perform the computer-implementable method for firing a projectile in response to a threat as recited of claim 1.

10. A computer-implementable method according to claim 1, wherein the physical interface includes a tether.

11. A computer-implementable method according to claim 1, wherein the launching initiates before the calculating is completed.

12. A computer-implementable method according to claim 1, wherein calculating the initial fire control solution comprises deriving the initial fire control solution from a look-up table according to a predicted intercept point, and wherein the look-up table comprises predetermined countermeasure fire control solutions for multiple engagement scenarios.

13. A system for firing a projectile in response to a threat, comprising a computer configured to:

select the projectile from multiple available projectiles;

calculate an initial fire control solution according to a characteristic of the selected projectile;

calculate a final fire control solution according to a characteristic of the selected projectile, wherein calculating the final fire control solution comprises deriving the final fire control solution from a look-up table according to a predicted intercept point, wherein the look-up table comprises predetermined countermeasure fire control solutions for multiple engagement scenarios, and wherein the final fire control solution is an updating of the initial fire control solution;

initiate a launch of the selected projectile, wherein the initiating includes sending a launch signal;

before initiating the launch, provide the initial fire control solution to the selected projectile; and after initiating the launch, provide the final fire control solution to the selected projectile, wherein the computer is further configured to provide the final fire control solution to the selected projectile over a physical interface with the projectile that releases after the launching.

14. A system according to claim 13, wherein the computer is further configured to calculate the predicted intercept point according to sensor data relating to the threat and the characteristic of the selected projectile.

15. A system according to claim 13, wherein the computer is further configured to control a fuze to detonate a warhead on the projectile according to the fire control solution.

16. A system according to claim 13, wherein the computer is further configured to select the projectile according to a predicted time of flight of the projectile to the predicted intercept point.

17. A system according to claim 13, wherein the computer is further configured to select the projectile according to a predicted engagement angle of the projectile relative to the threat.

18. A system according to claim 13, wherein the look-up table comprises a collection of predetermined countermeasure fire solutions for multiple predicted intercept points.

19. A system according to claim 13, wherein calculating the initial fire control solution comprises deriving the initial fire control solution from a look-up table according to a predicted intercept point, and wherein the look-up table comprises predetermined countermeasure fire control solutions for multiple engagement scenarios.

20. A method for firing a projectile in response to a threat, comprising:

selecting the projectile from multiple available projectiles;

calculating an initial fire control solution according to a characteristic of the selected projectile;

calculating a final fire control solution according to a characteristic of the selected projectile, wherein the final fire control solution is an updating of the initial fire control solution;

receiving a launch signal to initiate a launch of the projectile:

initiating the launch of the selected projectile from a launcher;

before the launching initiates, providing the initial fire control solution to the selected projectile;

after the launching initiates, providing the final fire control solution to the selected projectile; and guiding the selected projectile according to the final fire control solution, wherein the providing occurs over a physical interface that releases after the launching.

21. A method according to claim 20, wherein the physical interface includes a tether.

22. A method according to claim 20, wherein the providing occurs while at least part of the selected projectile is in the launcher.

* * * * *